US011220829B2

(12) United States Patent
Fontes

(10) Patent No.: US 11,220,829 B2
(45) Date of Patent: Jan. 11, 2022

(54) SYSTEM FOR THE SAFETY OF WORKERS INSTALLING ESCALATORS

(71) Applicant: Ronald Fontes, Pompano Beach, FL (US)

(72) Inventor: Ronald Fontes, Pompano Beach, FL (US)

( * ) Notice: Subject to any disclaimer, the term of this patent is extended or adjusted under 35 U.S.C. 154(b) by 637 days.

(21) Appl. No.: 16/142,382

(22) Filed: Sep. 26, 2018

(65) Prior Publication Data

US 2020/0095786 A1 Mar. 26, 2020

(51) Int. Cl.
*E04G 21/32* (2006.01)
*E04H 17/02* (2006.01)

(52) U.S. Cl.
CPC ..... *E04G 21/3204* (2013.01); *E04H 17/02* (2013.01)

(58) Field of Classification Search
CPC . E04G 21/32; E04G 21/3204; E04G 21/3214; E04G 21/3223; E04G 13/062; E04F 11/1859; E04F 11/1865; B66B 23/22; B66B 23/24; E04H 17/02; E04H 17/08; E04H 17/12; E04H 17/124; E04H 17/127
See application file for complete search history.

(56) References Cited

U.S. PATENT DOCUMENTS 3,018,077 A * 1/1962 Buehler ..... E04F 11/181 248/539
3,863,900 A * 2/1975 Dagiel ..... E04G 21/3233 256/59
4,979,725 A * 12/1990 Hutchings, II ..... E04G 5/06 182/82
5,182,889 A * 2/1993 Johnson ..... E04G 21/3219 52/298
5,314,167 A * 5/1994 Holloman ..... E04G 21/3223 182/113
5,456,451 A * 10/1995 Eyler, Jr. ..... E04G 21/3223 256/67
5,573,227 A * 11/1996 Hemauer ..... E04G 21/3214 256/65.06
5,711,398 A * 1/1998 Bartholomew ..... E04G 21/3214 182/45
6,679,482 B2 * 1/2004 Allenbaugh ..... E04G 21/3233 182/113
6,840,015 B1 * 1/2005 Ashley ..... E04G 5/04 52/90.1

(Continued)

FOREIGN PATENT DOCUMENTS

GB 2580333 * 7/2020
WO WO-2012026673 A2 * 3/2012 ..... E04G 21/3214

*Primary Examiner* — Jonathan P Masinick
(74) *Attorney, Agent, or Firm* — Melvin K. Silverman

(57) ABSTRACT

A system for the safety of those installing escalator systems having structural supports. A hand-rail is utilized having at least one post, each post made of an upper portion and a lower portion. The upper portion contains a top rail slot and a bottom rail slot for a cable to pass through, the cable is tensioned at a cable tension mount which can be located along the side of the escalator structure or to the bottom ground surface or top ground surface. The lower portion of the post contains a bottom mount and mid-bottom mount, which mount to the side of the escalator structure at the desired location of the user. This hand-rail system eliminates the need for a worker to wear a safety harness and tether to a cable which restricts motion.

8 Claims, 5 Drawing Sheets

(56) References Cited

U.S. PATENT DOCUMENTS

| | | | | |
|---|---|---|---|---|
| 9,140,022 | B2 * | 9/2015 | Gilbert-Williams | E04G 5/041 |
| 9,493,959 | B2 * | 11/2016 | Gutierrez | E04F 11/1808 |
| 10,233,601 | B2 * | 3/2019 | Gerrard | E04H 17/22 |
| 10,287,786 | B2 * | 5/2019 | Gurtler | A62B 35/0068 |
| 10,689,866 | B2 * | 6/2020 | Baca | E04G 5/14 |
| 2005/0193646 | A1 * | 9/2005 | Malenfant | E04G 21/3223 52/146 |
| 2007/0246299 | A1 * | 10/2007 | Wright | E04G 21/3242 182/113 |
| 2016/0305152 | A1 * | 10/2016 | Kozyra | E01F 15/02 |
| 2018/0347217 | A1 * | 12/2018 | Brogden | E04G 21/185 |
| 2020/0094085 | A1 * | 3/2020 | Wilson | A62B 35/005 |

* cited by examiner

SYSTEM FOR THE SAFETY OF WORKERS INSTALLING ESCALATORS

FIELD OF THE INVENTION

The present invention relates to the safe installation of escalators in any multi-story building.

BACKGROUND OF THE INVENTION

Escalators have been in installed and used by multi-story buildings for over 100 years. In current standard practice, one of the many dangers with the installation process is the danger of a worker falling off the edges of the motionless escalator, when the handrails are not installed. Currently, the system in place to prevent harm and serious injury to the workers is a wire and tether system.

The wire and tether system is simple, it typically comprises a wire that is secured at a height similar to that of the proposed height of the escalator handrail itself, and it also comprises a safety harness device that is worn by the worker. The wire is typically fastened at both ends to be properly tensioned. When the worker is ready to walk up the steps, the worker will take a clip that is part of the worn safety harness device and will tether him/herself to the wire and will then be able to walk upstairs and downstairs at their leisure without fear of falling to the hard ground below.

Some of the issues presented with the above art is that the worker is limited in movements with the harness. First, the harness presents and added weight to the worker. Next, being that the clip is in close proximity to the harness itself, the workers range of motion becomes restricted. It also becomes quite tedious for workers to be hooking and unhooking themselves from the wire every time they need to reach far enough to go beyond the harness's allowable range of motion, not to mention hooking and unhooking every time the stairway is entered.

The present invention sets out to solve the issues presented above and make it simple, safe, and less restrictive on the worker to install the escalator and move as necessary while doing it. The present invention utilizes a hand-rail system that is tensioned properly at either end and utilizes posts to support and guide the tensioned cables. The system allows for the worker to hold onto the handrail for stability while ensuring that the worker will be able to grab hold if the worker trips on any stairway hazard. The handrail eliminates the need of a harness and tether. The handrail system is temporary, and removable once the escalator installation reaches a point where permeant rails are in place.

SUMMARY OF THE INVENTION

The instant invention relates to a system for the safety of workers installing an escalator system comprising at least one post which is made of an upper and lower portion. The lower portion having a bottom mount and a mid-bottom mount on each of the lower portions of the posts. The bottom mounts have a support bracket which is connected to a back side of each post and the support bracket has a slot which is connectable to a bottom cross member of the escalator. The mid-bottom mounts have a support bracket connected to a back side of each post, the support bracket has a slot which is connectable to a top cross member of the escalator. The mid-bottom mount bracket can be fastened to the escalator by use of a threaded locking bolt which contacts the upper cross member of the escalator. Each post has a top rail slot which is connected to a back side of the upper portion of the post at a top of the back side. Each post has a bottom rail slot which is connected to the back side of the upper portion of the post at a middle section of the back side of the post. Both the top rail slot and the bottom rail slot have an opening through the center which a cable, of proper length, can pass through. At an end or ends of the escalator there is at least one cable tension mount which is connectable to a ground surface.

In a preferred embodiment, there are multiple cable tensioning mounts which are fastenable at both the top and bottom ground surfaces of the escalator. In other embodiments, it is possible for only a top ground surface or only a bottom ground surface tension mount to be utilized.

An objective of this invention to eliminate the need for a safety tethering and/or safety harness system which is currently utilized by escalator installers.

A further objective of this system is to allow the workers a wider and more free range of motion by using the handrail system, therefore increasing efficiency of the workers and allowing for quicker installation while keeping safety at the forefront.

The aforementioned objects, features, and advantages of the invention will, in part, be pointed out with particularity, from the following drawings, Detailed Description of the Invention, and Claims herewith.

DETAILED DESCRIPTION OF THE INVENTION

For a more complete understanding of the present invention and advantages thereof, reference is now made to the following description of various illustrative and non-limiting embodiments thereof, taking in conjunction with the accompanying drawings in which like reference numbers indicate like features.

A standard, fully assembled, escalator typically has a handrail, steps on a conveyor, a bottom ground surface, and a top ground surface. Whether the escalator is moving or not, handrails provide patrons an element of safety which can be utilized during physically stair climbing or ascension with the escalator. Now, throughout the majority of the escalator construction and installation process, the handrails are not present and that is where the current invention becomes important.

Figure 1A:
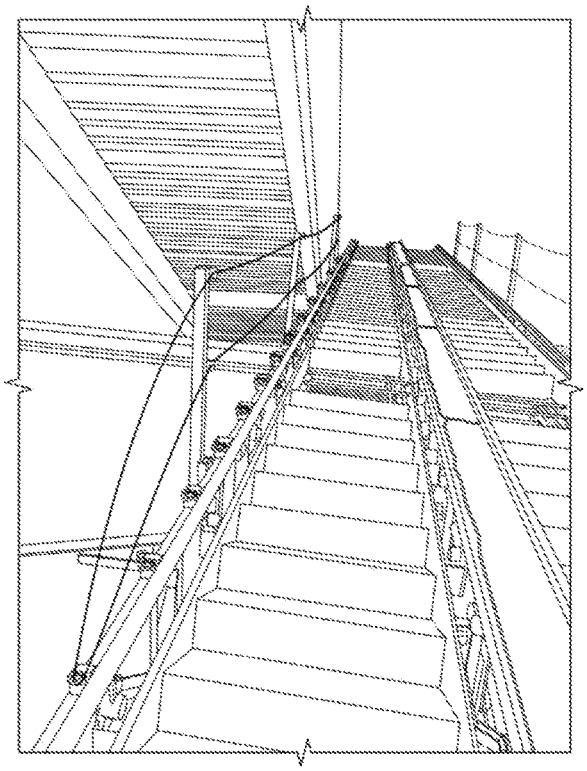
FIG. 1*a* is a first conceptual view of the present invention that is upward from the lowermost point of the escalator system.
Figure 1B:
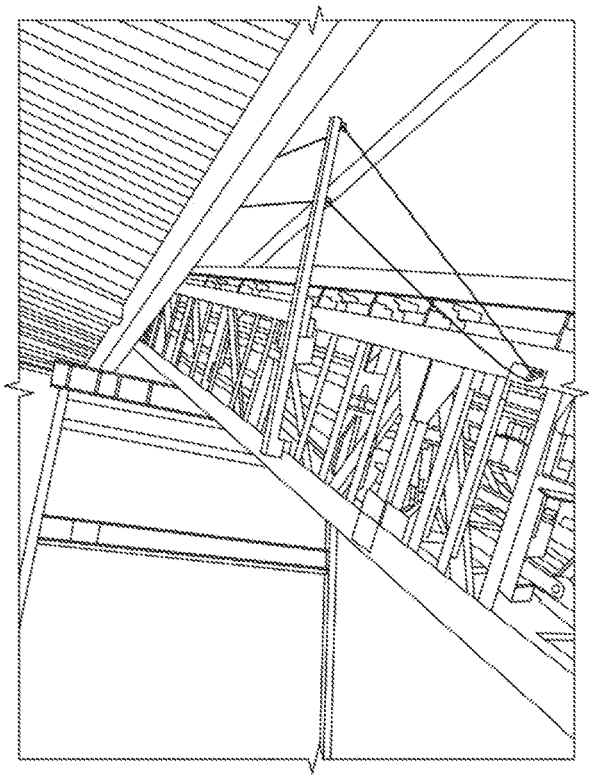
FIG. 1*b* is a second conceptual view of the present invention that is toward the side escalator structure.
Figure 1C:
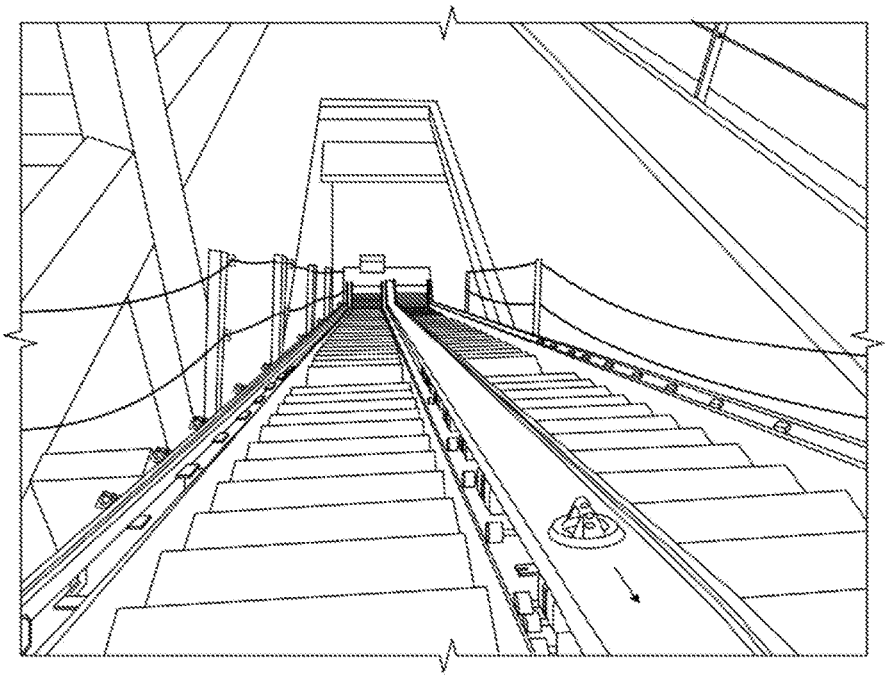
FIG. 1*c* is third a conceptual view of the present invention that is downward from the uppermost portion of an escalator.
Figure 2:
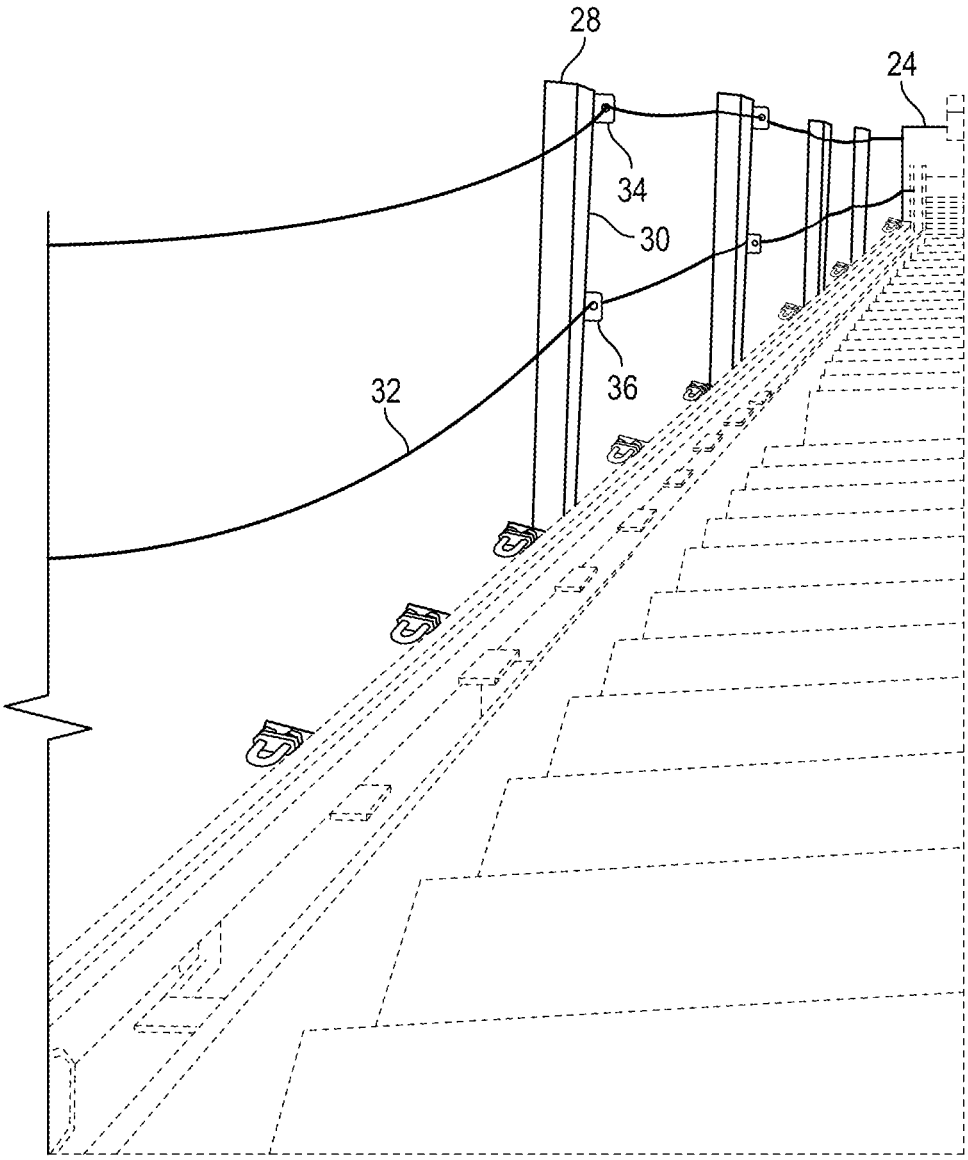
FIG. 2 is a schematic view of the present invention downward from the uppermost portion of an escalator.
Figure 3:
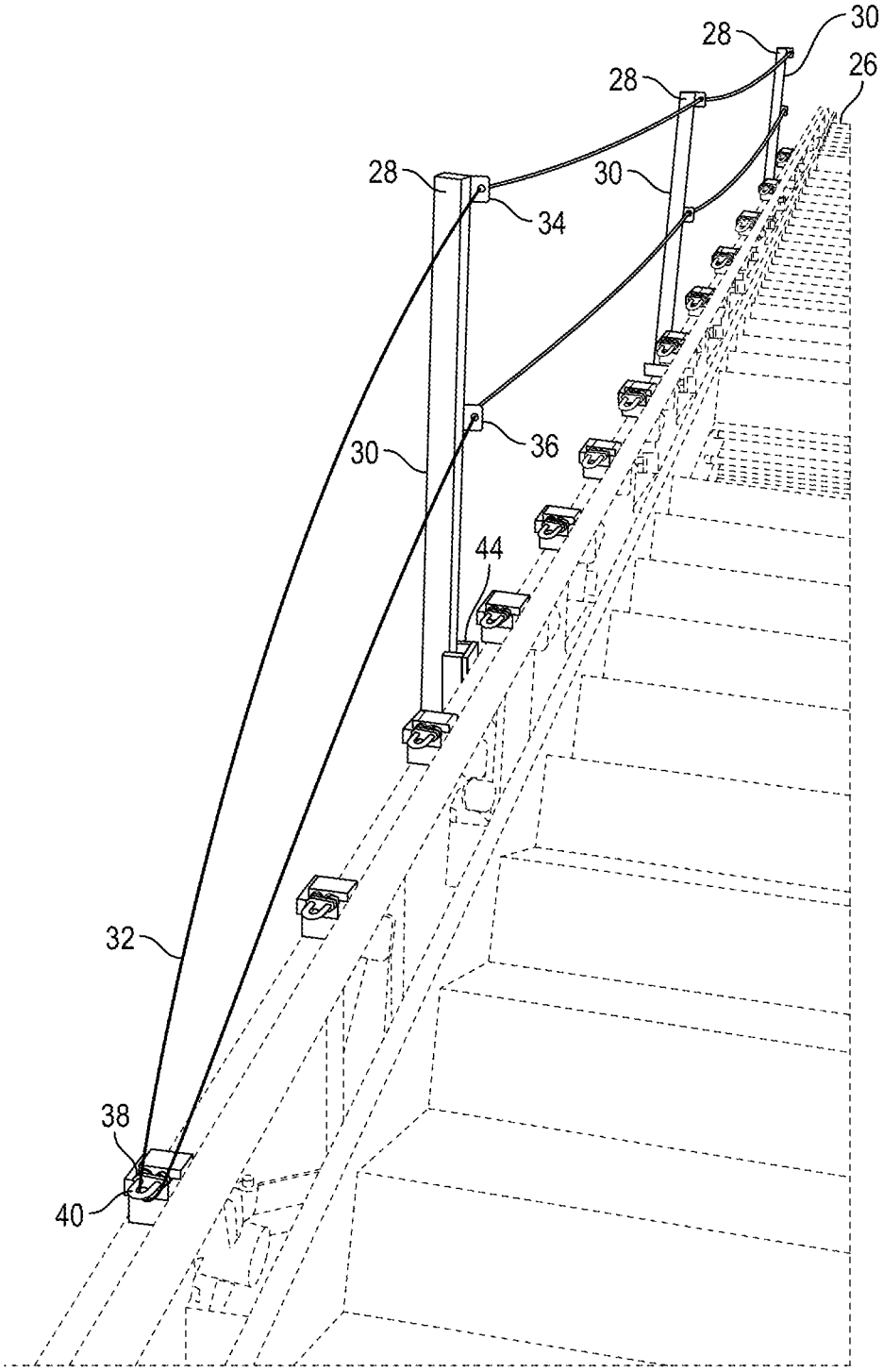
FIG. 3 is a schematic view of the present invention upward from the lowermost point of an escalator.
Figure 4:
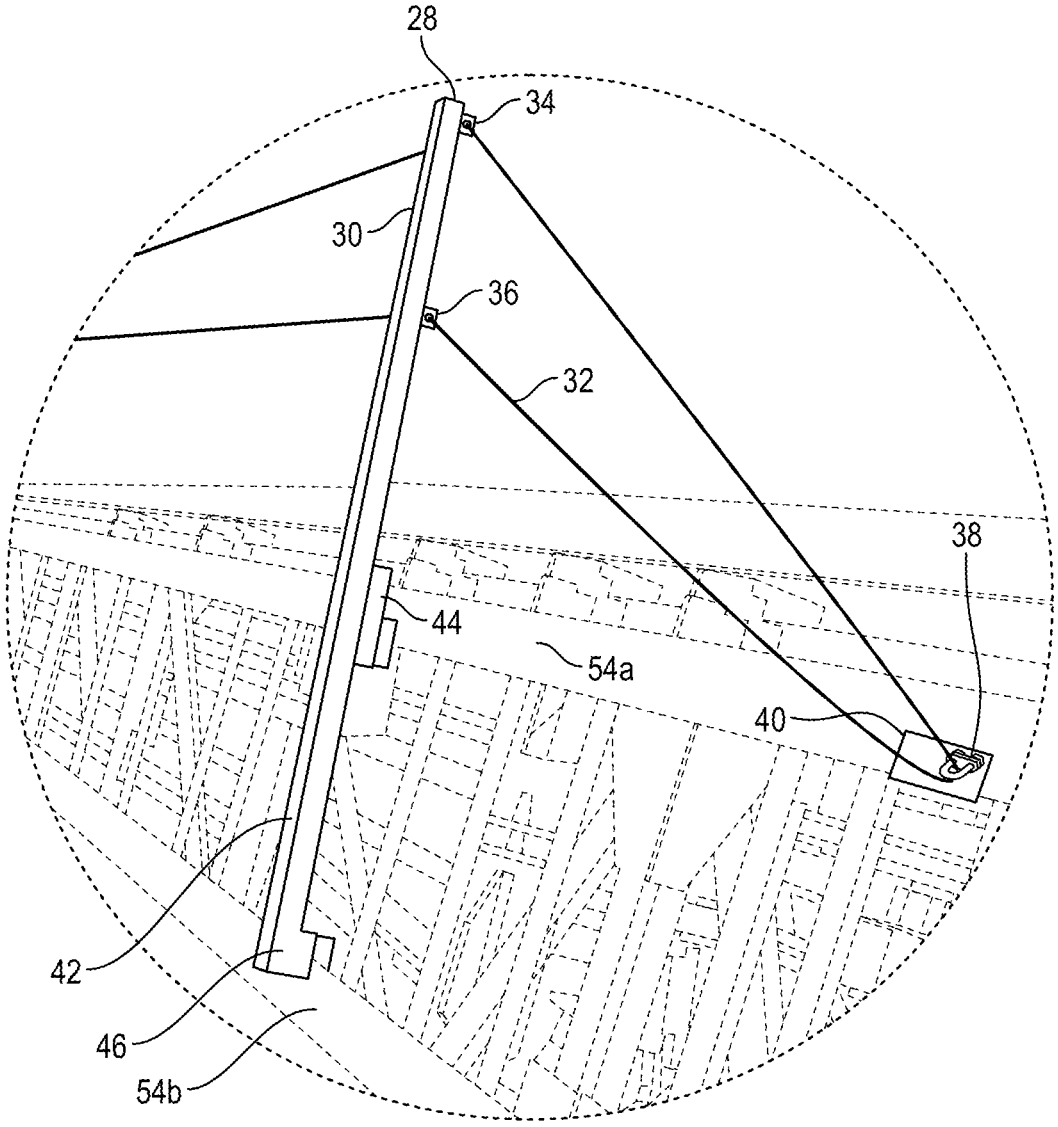
FIG. 4 is a schematic view of the present invention from a ground perspective at the side profile of an escalator.

Conceptual views are shown in FIGS. 1*a*, 1*b*, and 1*c* to demonstrate how the overall invention will be implemented in a multi-story building escalator construction. In FIGS. 2, 3, and 4, the present invention is shown from multiple perspectives. More specifically, in FIG. 2, a downward view of the invention in its preferred embodiment looking down to the bottom ground surface 24 from an area of the escalator nearing the top. At least one post 28, here in the preferred embodiment a plurality of posts 28, with only the upper portion 30 in sight, are shown with a cable 32 that extends to each end of the escalator. The cable 32 is slotted through both a top rail slot 34 and bottom rail slot 36. The top rail slot 34 and bottom rail slot 36 suspend the cable 32 at a proper height in order to meet the varying heights of a person either standing, sitting, or crouching while working on the escalator.

In FIG. 3, the cable 32 can clearly be seen as fastened to a cable tension mount 38 that is made up of an end plate 40 which can be clipped to a kind of clip such as a "Crosby Clip", not shown, that is commonly seen in fastening cable ends. The end plates 40 are mounted to the top cross member of the escalator structure 54*a*, seen more clearly in FIG. 4. The cable 32 can be tensioned at multiple points on the escalator depending on what the scope of work in the installation may be at a given point. At some times it is best to have the cable 32 span the whole length of the escalator, sometimes it may be best to only tension it down to a certain distance, it can vary.

Figure 5:
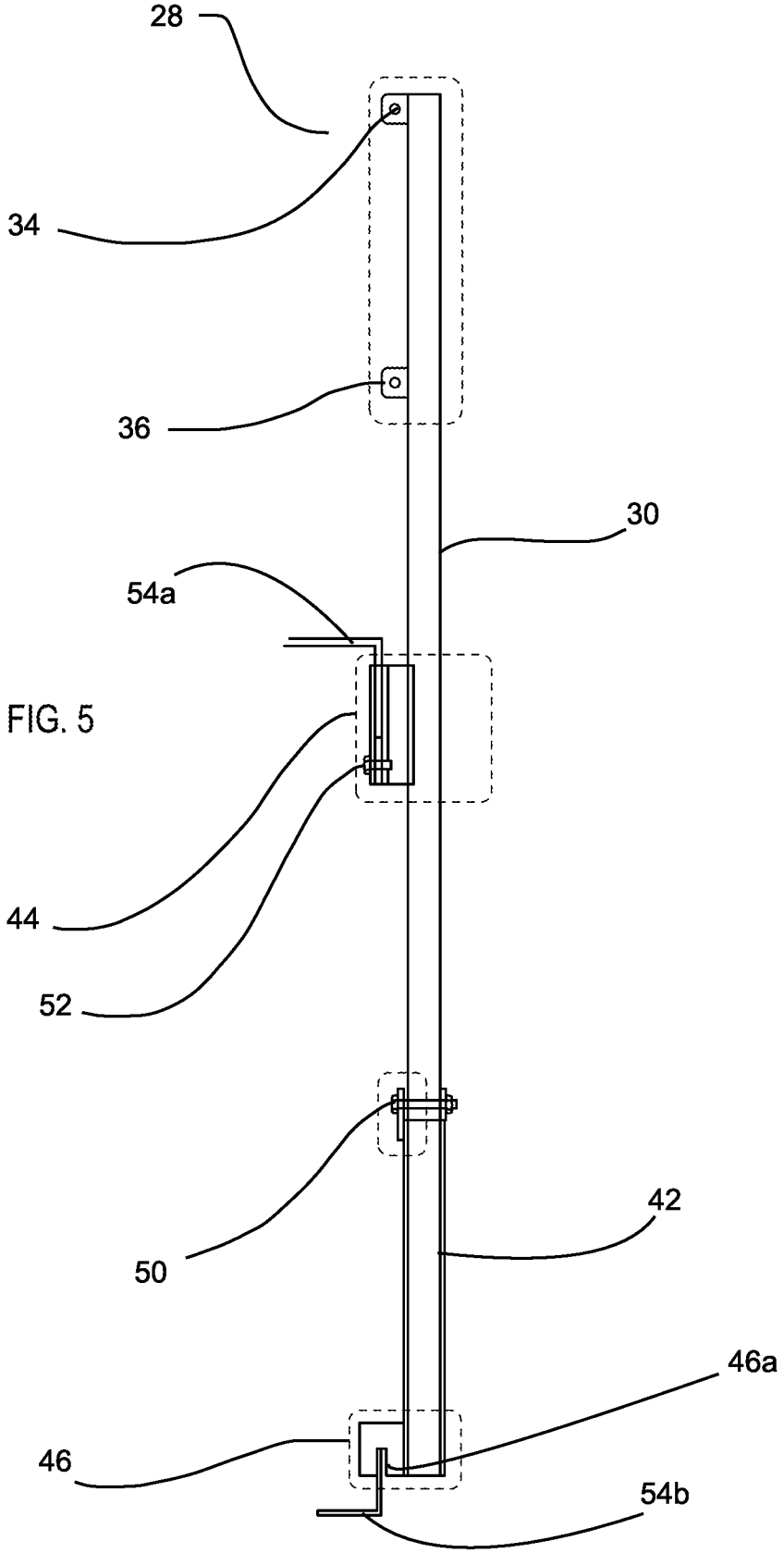
FIG. 5 is an isolated view of the at least one post and its aspects.

Focusing on the at least one post 28, FIGS. 4 and 5 give the best view of the post 28 in its entirety. FIGS. 4 and 5 showcase a bottom mount 46 and mid-bottom mount 44 on the lower portion 42 of the post 28. In some embodiments, the upper portion 30 and lower portion 42 are two separate pieces which can be mated together by a mating point 48, whereby the upper portion 30 fits into the lower portion 42 and can be secured by a bolt 50. The upper portion 30 therefore becomes adjustable depending on the different widths associated with the side of the escalator structure for which it will be utilized, more specifically the width between the top cross member of the escalator structure 54*a* and bottom cross member 54*b*. There are two modes of post 28 installation, one-piece and-two piece. An embodiment in which there is one-piece installation insists that the upper portion 30 and lower portion 42 already be secured at the mating point 48 and a two-piece installation sees the lower portion 42 installed before the upper portion 30 is mated. Looking at FIG. 4, it can be seen that the bottom mount 46 and mid-bottom mount 44 must fit within the edges of the side of the escalator structure. It may be appreciated that the lower portion 42 extends below the escalator structure 54*a* and secures to the bottom cross member 54*b*. Bottom mount 46 is shown to have an open slot 46*a*, wherein the bottom cross member may fit into. As shown in the drawings, no bolt of fastening mechanism is included because the standard truss depth of typical escalators exceeds the length of a human arm, which would make tightening such a bolt difficult. Because of this, the slot 46*a* allows a user to install the post 28 as discussed herein by aligning the slot 46*a* over the cross bottom member 54*a* and pivoting the post 28 back to a flush position with the escalator structure, as may be seen in FIG. 4. Thus, bottom mount 46 can be seen as a non-fixed connection.

In a one-piece installation embodiment, it is desirable to insert the lower portion into the side of the escalator structure at a 45-degree angle to be able to then re-adjust the post back to a 90-degree angle once the mid-bottom mount slots into the top cross member of the escalator structure 54*a*, at the bottom cross member of the escalator structure 54*b* as shown in FIGS. 4 and 5. As it is put back to the 90-degree position, the mid-bottom mount will rest on the bottom side of the escalator structure 54*b*, shown in FIGS. 4 and 5. Once in place, the mid-bottom mount can be secured to the top cross member of the escalator structure 54*a* by a locking-bolt 52.

In a two-piece installation, the same process as described above wherein the lower portion enters at a 45-degree angle and then rotated back to 90-degrees to be fastened by the locking-bolt 52. Once the lower portion 42 is in place, the upper portion 30 can be simply mated into the lower portion 42 and fastened with the bolt 50.

The present invention remains on the escalator until the permanent handrails are installed on the escalator, eliminating the need for the worker to wear a safety harness and tether to a cable which becomes tedious and cumbersome on the worker's range of motion.

In some embodiments, the invention provides a temporary, reusable system for the safety of workers installing escalators having structural supports. The system includes at least one post 28, with most embodiments having a plurality of posts, as may be seen in FIG. 3. Each post 28 has an upper portion 30 and a lower portion 42, a non-fixed bottom mount 46 and a fastenable mid-bottom mount 44. These mounts 44/46 are on the lower portion of each post. The said bottom mount have a support bracket connected to a back side of each post 28. The bottom mounts 46 have a slot 46*a* securable to a bottom cross member 54*b* of an escalator, wherein the slots 46*a* do not fixedly connect, but allow the post to grip to a lower member 54*b* when pivotally straightened and bolted at the mid-bottom mount 44. That is, the slot 46*a* is configured for complemental engagement of the bottom cross member 54*b* to secure the post 28 to the elevator without the use of a fastener, such as a bolt. The mid-bottom mount 44 has a hooking bracket connected to the back side of the post 28, wherein the hooking bracket is connectable to a top cross member 54*a* of the escalator by the bolt 52. Each post has a top rail slot 34 connected to the back side of the upper portion 30 of the post 28 at a top of the back side of the post 28, as shown in FIG. 5. Each post 28 has a bottom rail slot 36 connected to the back side of the upper portion 30 of the post 28 at a middle of the back side of the post 28. The top rail slot 34 has an opening through a substantial center of the top rail slot. The bottom rail slot 36 has an opening through a substantial center of said bottom rail slot. The system includes a single continuous cable 32 of proper length. The continuous cable 32 is slotted through a series of top rail slots 34, looped through the cable tension mount 38, and then through a series of bottom rail slots 36. The system includes at least one cable tension mount 38, but in some embodiments, may be a plurality of tension mounts, as shown in FIG. 3, spaced up the side of the elevator truss. Each time a user moves the post 28, a new tension mount 38 may be used. This is particularly useful when using a length of cable 32 that does not reach the entire length of the escalator. Each cable tension mount 38 is connectable to a side surface of an escalator.

It will be appreciated by persons skilled in the art that the present invention is not limited to what he has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A temporary, reusable system for the safety of workers installing escalators having structural supports, comprising:

at least one post, wherein said at least one post having has an upper portion and a lower portion;

said at least one post having a non-fastened bottom mount and mid-bottom mount on said lower portion of said at least one post;

said bottom mount having a support bracket connected to a back side of said at least one post, wherein said support bracket includes a slot therein for engagement with a bottom cross member of an escalator, whereby said slot provides for complemental engagement of said cross member to secure said post to said escalator without the use of a fastener;

said mid-bottom mount having a hooking bracket connected to said back side of said at least one post, said hooking bracket connectable to a top cross member of the escalator;

said at least one post having a top rail slot connected to said back side of said upper portion of said at least one post at a top of said back side of said at least one post;

said at least one post having a bottom rail slot connected to said back side of said upper portion of said at least one post at a middle of said back side of said at least one post;

said top rail slot having an opening through a substantial center of said top rail slot;

said bottom rail slot having an opening through a substantial center of said bottom rail slot;

at least one cable tension mount, wherein said at least one cable tension mount is connectable to a side surface of said escalator; and a single continuous cable of proper length, whereby said single continuous cable is slotted through said top rail slot, looped through one cable tension mount of said at least one cable tension mount, and slotted through said bottom rail slot.

2. The system as recited in claim 1, further comprising:

said at least one cable tension mount connectable at a ground surface at the bottom end of said escalator.

3. The system as recited in claim 1, further comprising:

said at least one cable tension mount connectable at a ground surface at the top end of said escalator.

4. The system as recited in claim 1, further comprising:

said at least one cable tension mount having a plurality of cable tension mounts connectable at both the top and bottom ends of said escalator.

5. The system as recited in claim 1, further comprising:

said at least one cable tension mount connectable to any point on the escalator sides.

6. The system as recited in claim 1, further comprising:

said upper portion fastenable to said lower portion by bolt.

7. The system as recited in claim 6, further comprising:

said upper portion adjustable in height for different widths between said top cross-member and said bottom cross member on the side of an escalator structure.

8. The system as recited in claim 1, further comprising:

said mid-bottom mount having an adjustable threaded locking bolt, said adjustable threaded locking bolt contactable with said top cross member of said escalator.

* * * * *